US007704099B1

(12) United States Patent
Hong et al.

(10) Patent No.: US 7,704,099 B1
(45) Date of Patent: Apr. 27, 2010

(54) MANUAL DISCONNECT SYSTEM

(75) Inventors: Kin Boon Hong, Singapore (SG); Lee Yin Chuang, Singapore (SG)

(73) Assignee: J.S.T. Corporation, Farmington Hills, MI (US)

( * ) Notice: Subject to any disclaimer, the term of this patent is extended or adjusted under 35 U.S.C. 154(b) by 0 days.

(21) Appl. No.: 12/273,628

(22) Filed: Nov. 19, 2008

(51) Int. Cl.
*H01R 13/66* (2006.01)

(52) U.S. Cl. ..... 439/620.29; 439/157

(58) Field of Classification Search ..... 439/157, 439/372, 620.27, 620.29–620.34, 76.2, 949
See application file for complete search history.

(56) References Cited

U.S. PATENT DOCUMENTS 6,773,307 B2 8/2004 Beer
7,249,958 B2 * 7/2007 Ishikawa et al. ..... 439/141
2002/0173186 A1 * 11/2002 Tsuchiya ..... 439/157

* cited by examiner

*Primary Examiner*—Ross N Gushi
(74) *Attorney, Agent, or Firm*—Rader, Fishman & Grauer, PLLC

(57) ABSTRACT

A manual disconnect system includes a battery part, a disconnect part, a circuit assembly and a fuse assembly with a fuse connector and a circuit connector connected to the battery part. The battery part has a main compartment and a fuse assembly subcompartment. The disconnect part is releasably connected to the battery part. The fuse assembly is releasably received by the fuse assembly subcompartment. When the disconnect part is connected to the battery part, the fuse assembly and the fuse connector are electrically connected together and the circuit assembly and the circuit connector are electrically connected together. Upon detaching the disconnect part and the battery part from each other, the circuit assembly and the circuit connector are electrically disconnected from one another while the fuse assembly remains releasably connected to the battery part in the fuse assembly subcompartment and electrically connected to the fuse connector.

22 Claims, 12 Drawing Sheets

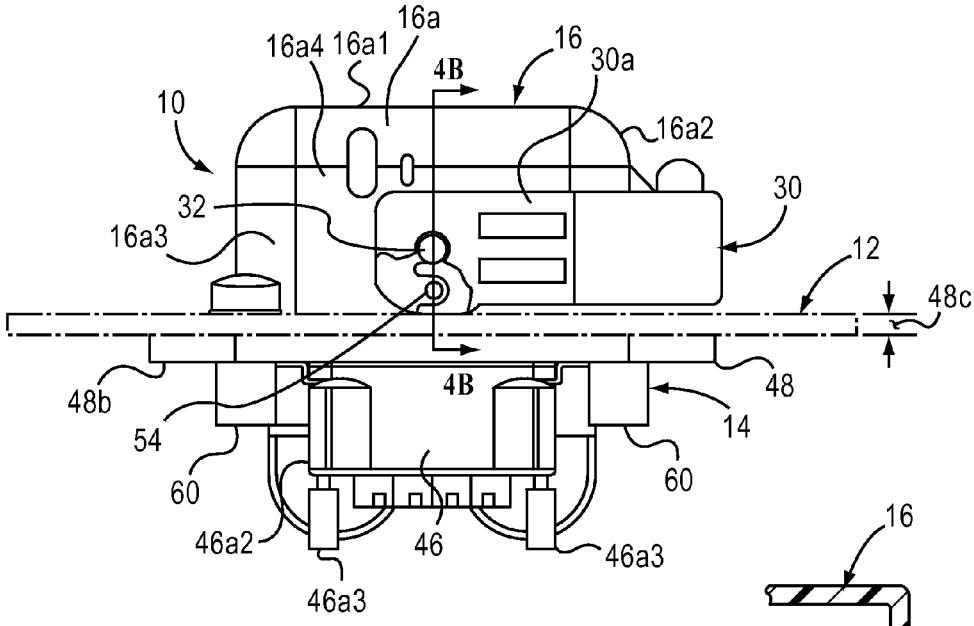
FIG.4A
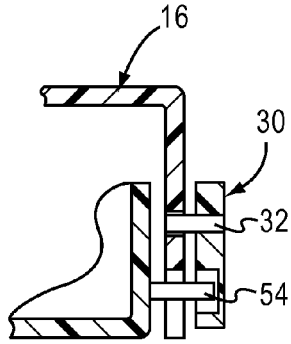
FIG.4B
FIG.4C
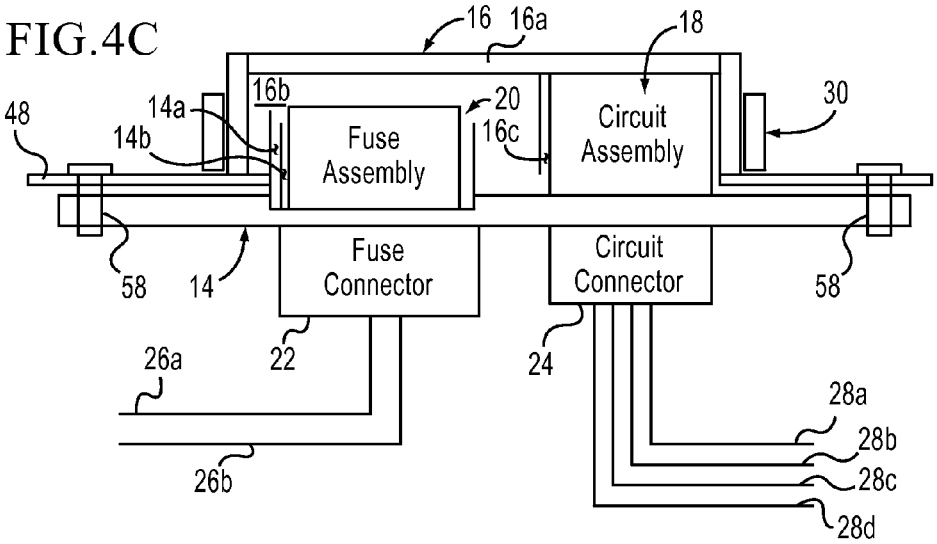

MANUAL DISCONNECT SYSTEM

FIELD OF THE INVENTION

The present invention relates to a manual disconnect system. More particularly, the present invention is directed to a manual disconnect system that, if desired, can be sealed.

BACKGROUND OF THE INVENTION

Manual disconnect units that facilitate electrical disconnection, particularly from high current connections, are known in the art. One such manual disconnect unit is disclosed in U.S. Pat. No. 6,773,307. This high current disconnect unit includes a fuse, a current limiting resistor, a manual disconnection device and a pair of connection elements for connecting the high current disconnect system to an electrical circuit. The manual disconnect unit is wired in series with the fuse and provides a user selectable circuit interrupt. The current limiting resistor is wired in parallel with the manual disconnection unit and in series with the fuse. The manual disconnection unit is wired in series with the fuse and provides a user selectable circuit.

However, there are drawbacks in prior art manual disconnect units. For instance, the disconnect unit is not sealed. Also, the disconnect unit requires a large footprint for installation. Further, this particular disconnect unit requires a hand tool or a power tool to remove the connector.

It would be beneficial to provide a manual disconnect system that, if desired, can be sealed, occupies a relatively small footprint and enables a user to remove the connector without using any tools. The present invention provides these benefits.

OBJECTS AND SUMMARY OF THE INVENTION

It is an object of the invention to provide a manual disconnect system that, if desired, can be sealed.

It is another object of the invention to provide a manual disconnect system that occupies a relatively small footprint.

It is another object of the invention to provide a manual disconnect system that enables a user to remove the connector without using any tools.

Accordingly, a manual disconnect system of the present invention is hereinafter described and includes a battery part, a disconnect part, a circuit assembly, a fuse assembly, a fuse connector and a circuit connector. The battery part has a main compartment with fuse assembly subcompartment disposed in the main compartment. The disconnect part has a shielding cover that defines a disconnect part cavity with the disconnect part being releasably connected to the battery part. The circuit assembly is disposed in the disconnect part cavity and is connected to the shielding cover. The fuse assembly is sized and adapted to be releasably received by the fuse assembly subcompartment. The fuse connector and a circuit connector are connected to the battery part. When the disconnect part is releasably connected to the battery part, the fuse assembly and the fuse connector are electrically connected together and the circuit assembly and the circuit connector are electrically connected together. Upon detaching the disconnect part and the battery part from each other, the circuit assembly and the circuit connector are electrically disconnected from one another while the fuse assembly remains releasably connected to the battery part in the fuse assembly subcompartment and electrically connected to the fuse connector.

These objects and other advantages of the present invention will be better appreciated in view of the detailed description of the exemplary embodiments of the present invention with reference to the accompanying drawings, in which:

BRIEF DESCRIPTION OF THE DRAWINGS

FIG. 4A is a side elevation view of the manual disconnect system shown in FIG. 1.

FIG. 4B is a partial cross-sectional view of the manual disconnect system taken along line 4B-4B in FIG. 4A.

FIG. 4C is a diagrammatical view of the manual disconnect system mounted to a support surface with a disconnect part releasably connected to a battery part and with a lever member in a locked state.

DETAILED DESCRIPTION OF THE EXEMPLARY EMBODIMENTS

Figure 1:
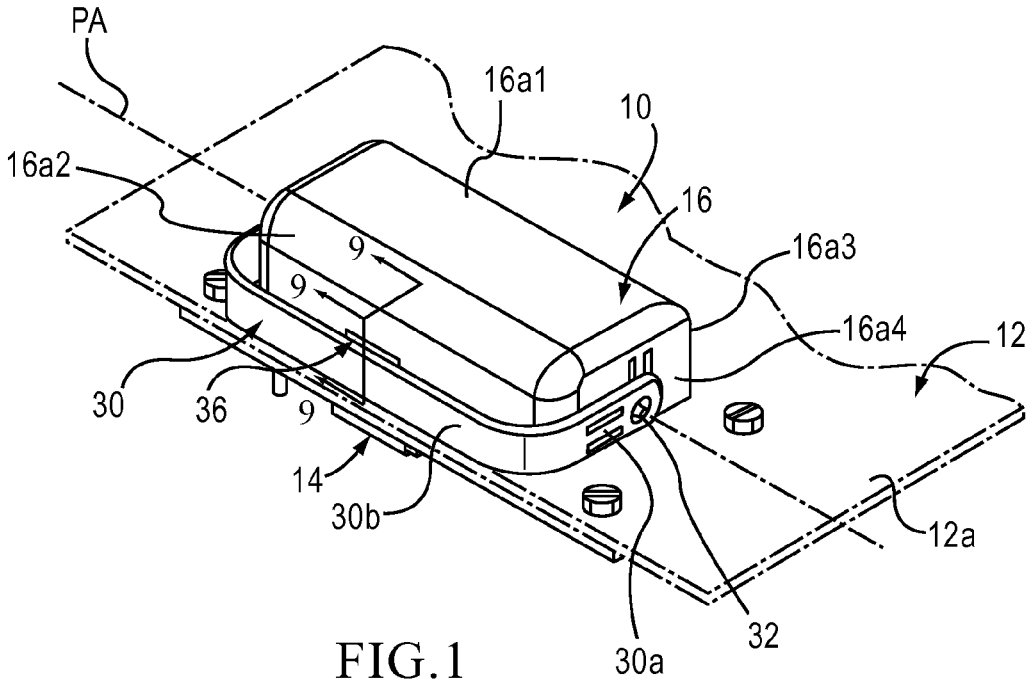
FIG. 1 is a top-down perspective view an exemplary embodiment of a manual disconnect system of the present invention.

Hereinafter, embodiments of the present invention will be described with reference to the attached drawings. The structural components common to those of the prior art and the structural components common to respective embodiments of the present invention will be represented by the same symbols and repeated description thereof will be omitted.

Also, throughout the detailed description of the exemplary embodiments, more descriptive terms such as "above", "top", "front", "bottom" and the like are used in reference to the drawing figures and shall not be construed to limit the scope of the invention. These terms are considered to be more descriptive of the invention particularly as the orientation of the embodiments of the invention is shown the drawing figures. It is believed that the detailed description of the exemplary embodiments is easier for a reader to comprehend using the more descriptive terms rather than non-descriptive terms. However, one of ordinary skill in the art would easily comprehend that non-descriptive terms such as "first", "second" and the like could be used in their stead.

Figure 2:
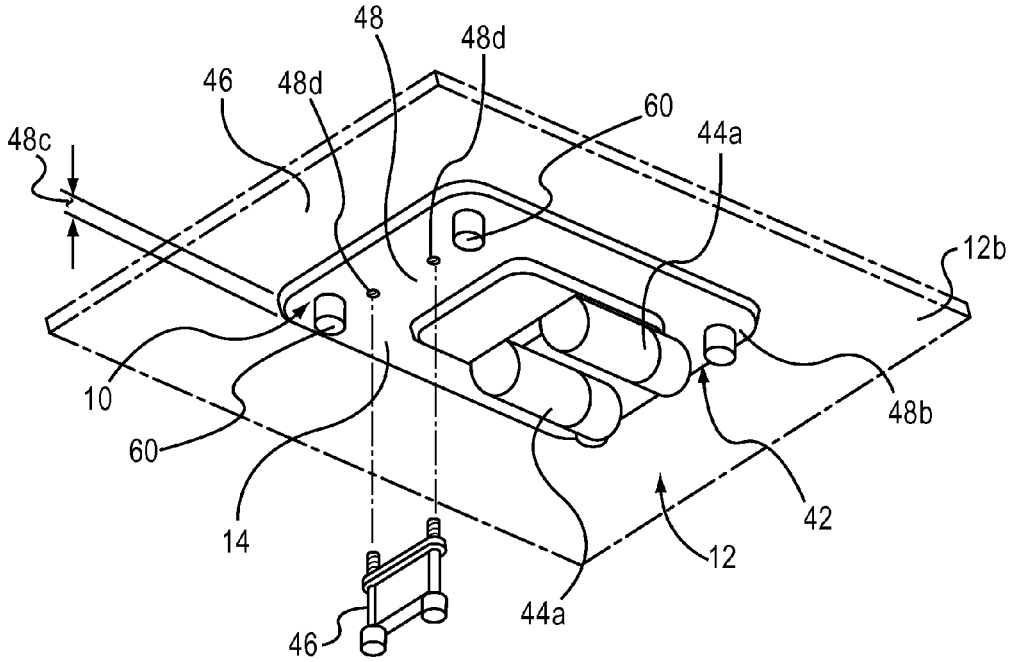
FIG. 2 is a bottom-up perspective view the manual disconnect system of the present invention shown in FIG. 1.
Figure 3A:
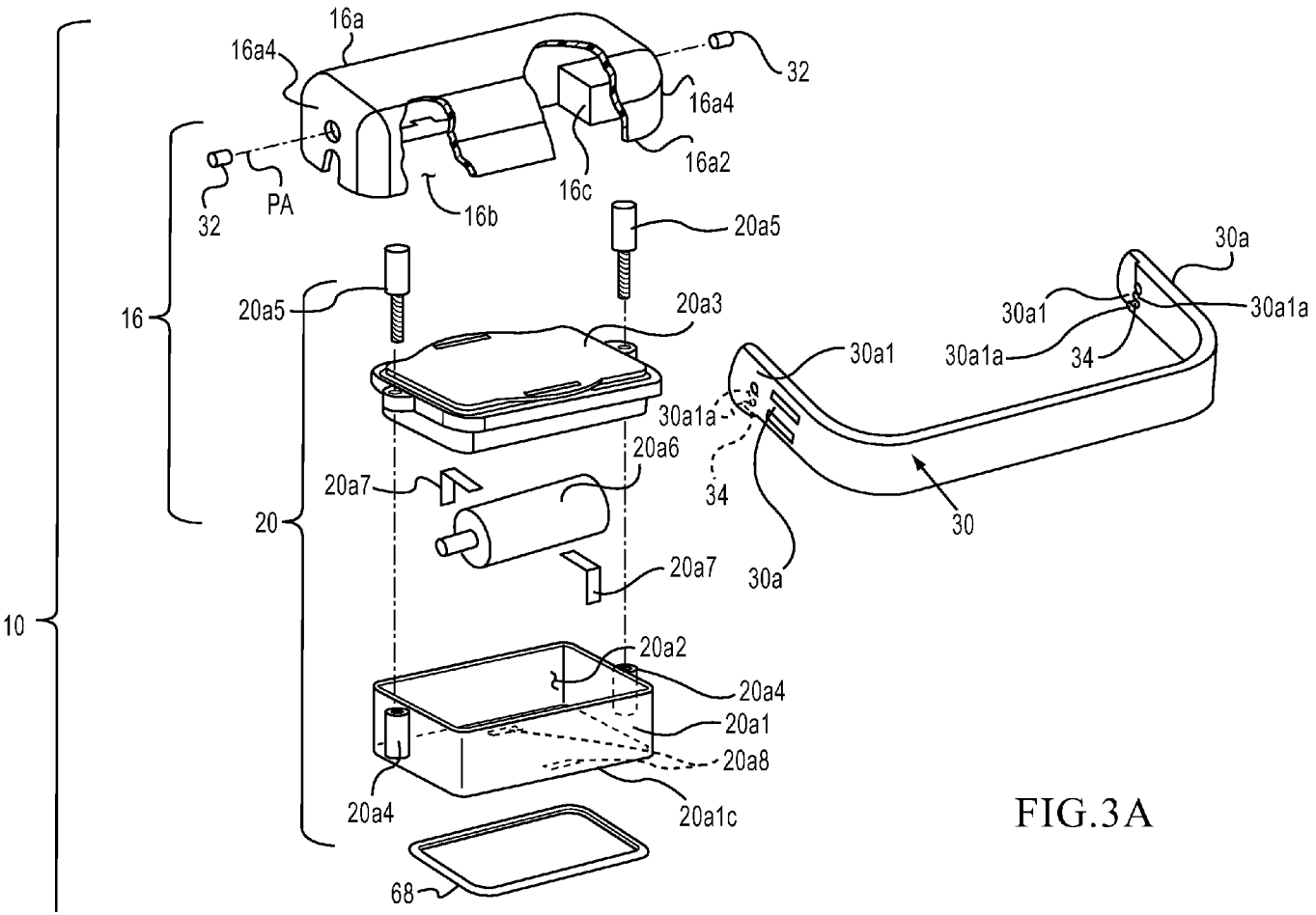
FIG. 3 is an exploded perspective view of the manual disconnect system shown in FIG. 1 with FIG. 3A being an upper portion thereof and FIG. 3B being a lower portion thereof.
Figure 3B:
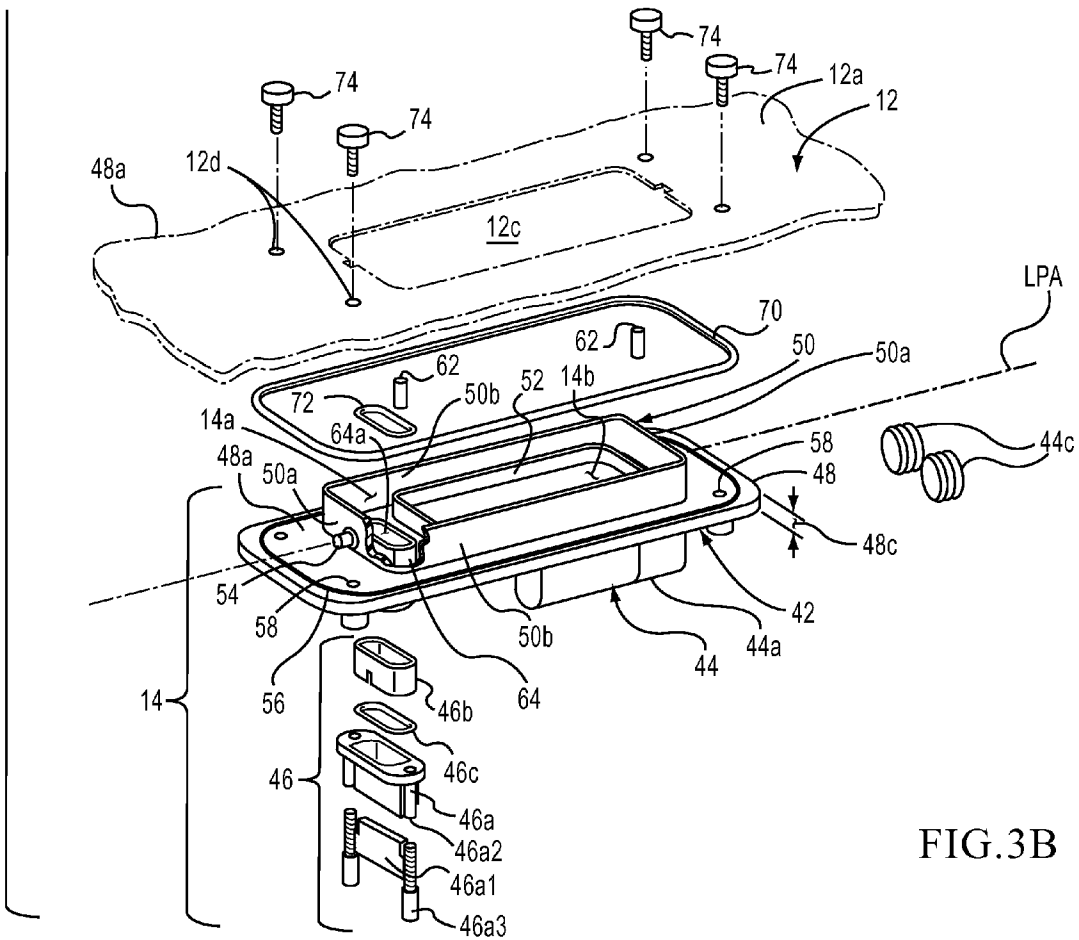

A first exemplary embodiment of a manual disconnect system 10 of the present invention is hereinafter described with reference to FIGS. 1-7B. As shown in FIGS. 1-3, the manual disconnect system 10 is adapted for mounting to a support member 12 such as, for example, a battery cover. The support member 12 has a top support surface 12*a*, an opposite bottom support surface 12*b*, a support member opening 12*c* (FIGS. 3A and 3B) formed through and between the top support surface 12*a* and the bottom support surface 12*b* and a plurality of support member attachment holes 12*d* disposed outwardly relative to the support member opening 12*c*. As shown in FIGS. 4A-7C, the manual disconnect system 10 includes a battery part 14, a disconnect part 16, a circuit assembly, 18 a fuse assembly 20, a fuse connector 22 and a circuit connector 24. A skilled artisan would appreciate that the circuit assembly 18 can be, for example, a conventional interlock loop circuit assembly while the circuit connector 24 can be, for example, a conventional interlock loop circuit connector. By way of example only and not by way of limitation, high voltage wires 26*a*-26*b* are connected to the fuse connector 22 and circuit wires 28*a*-28*d* are connected to the circuit connector 24.

Figure 5A:
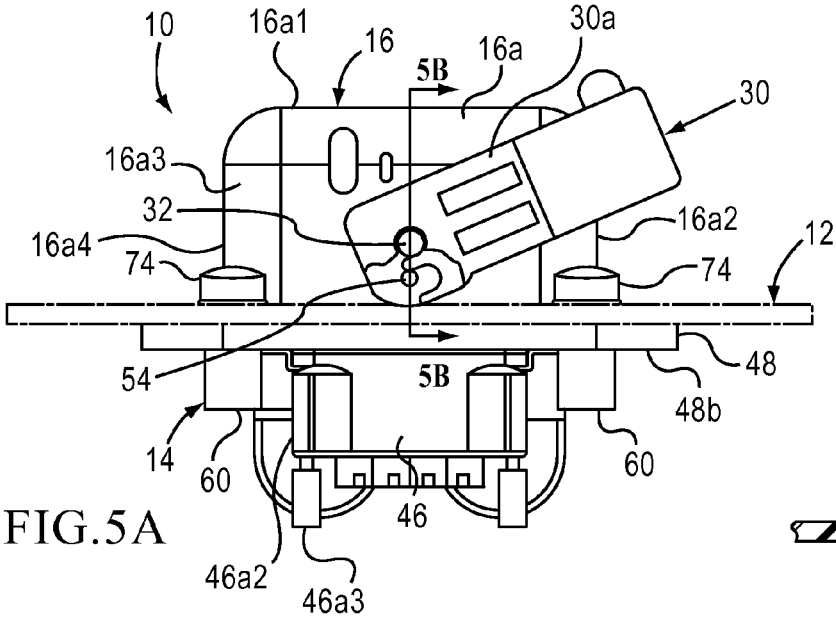
FIG. 5A is a side elevation view of the manual disconnect system similar to FIG. 4A with the lever member moving from the locked state to a release state.
Figure 5B:
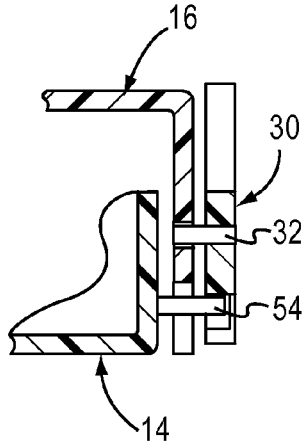
FIG. 5B is a partial cross-sectional view of the manual disconnect system taken along line 5B-5B in FIG. 5A.
Figure 5C:
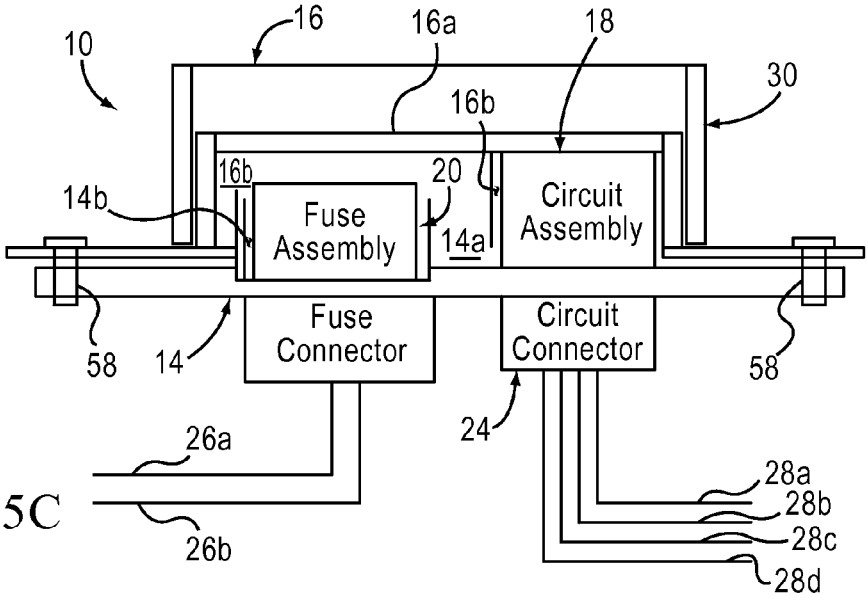
FIG. 5C is a diagrammatical view of the manual disconnect system mounted to the support surface with the lever member moving from a locked state to the release state.
Figure 6A:
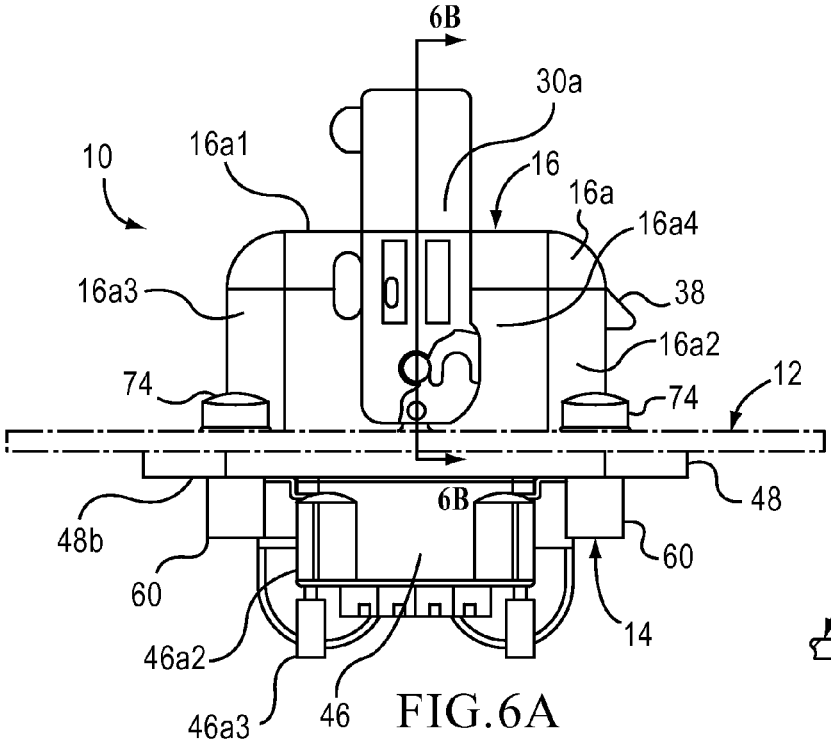
FIG. 6A is a side elevation view of the manual disconnect system similar to FIG. 4A with the lever member in the release state.
Figure 6B:
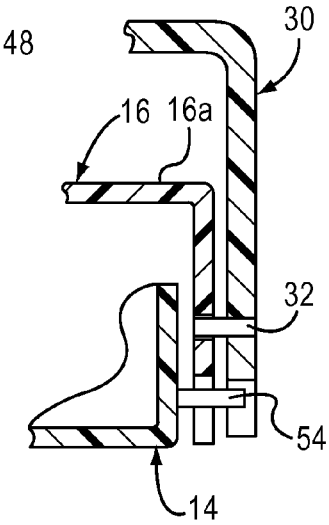
FIG. 6B is a partial cross-sectional view of the manual disconnect system taken along line 5B-5B in FIG. 5A.
Figure 6C:
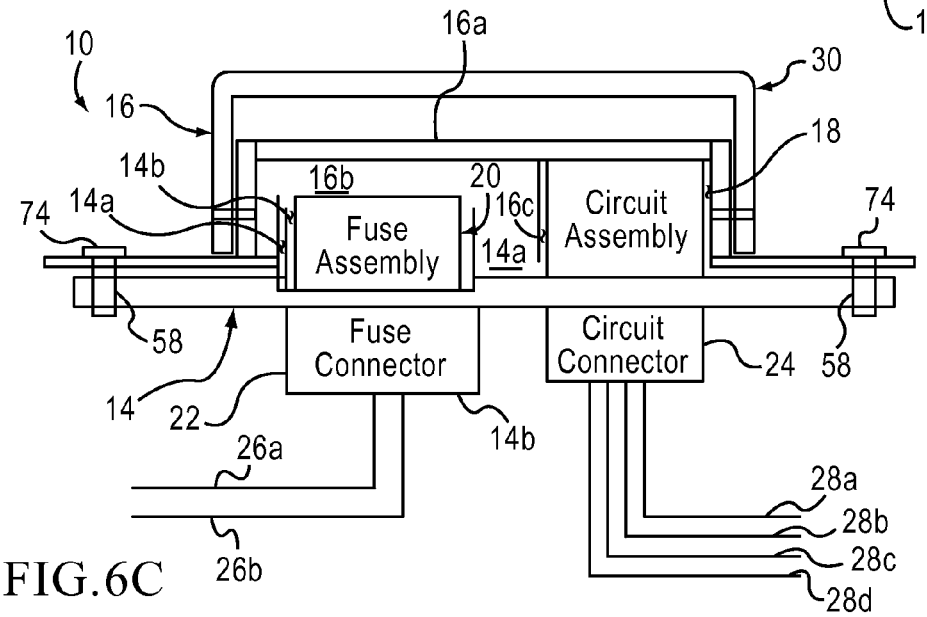
FIG. 6C is a diagrammatical view of the manual disconnect system mounted to the support surface with the lever member in the release state.
Figure 7A:
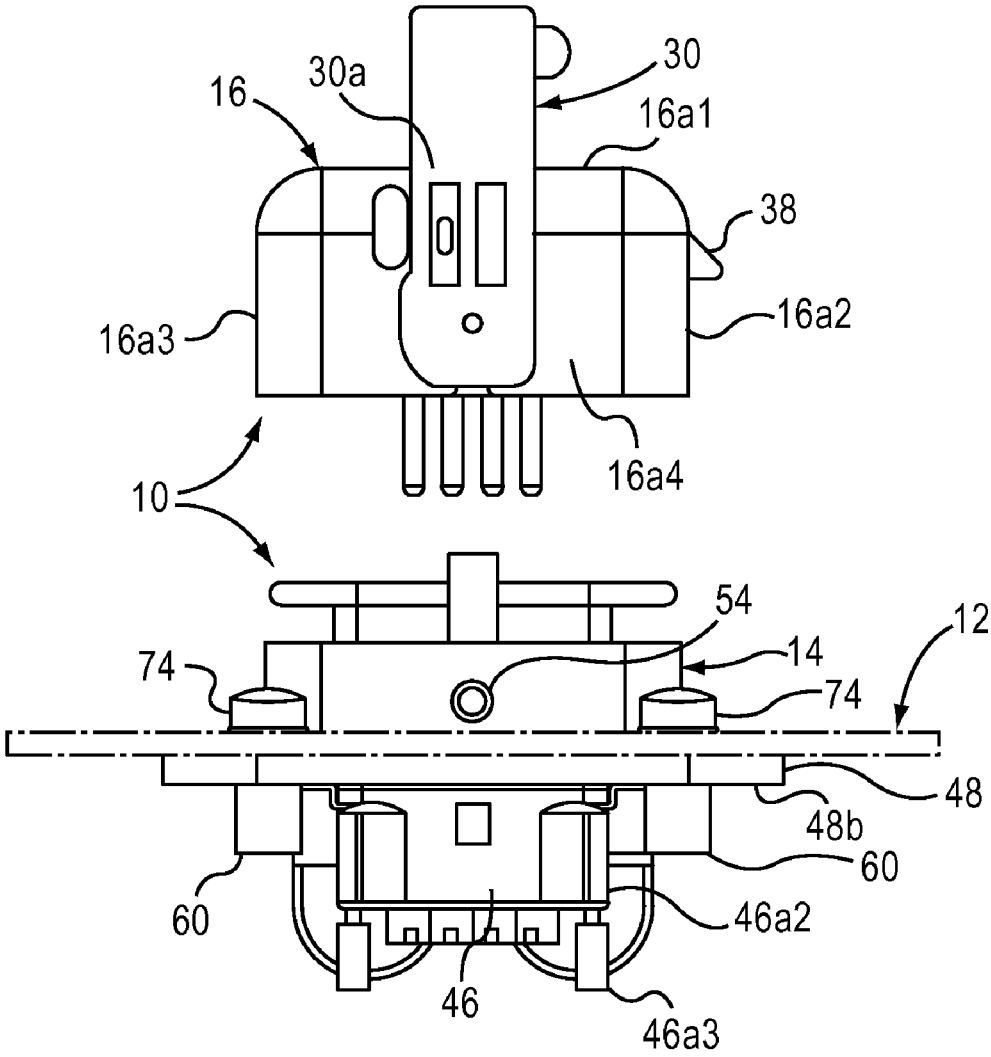
FIG. 7A is a side elevation view of the manual disconnect system with the disconnect part detached from the battery part.
Figure 7B:
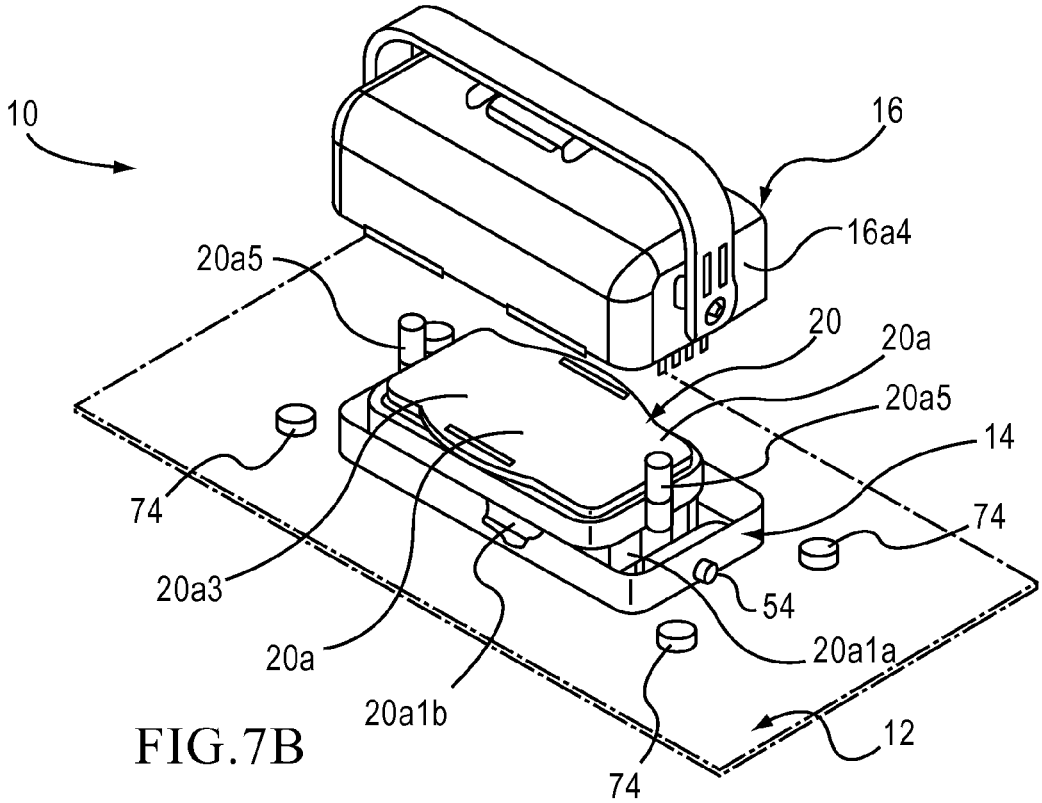
FIG. 7B is a perspective view of the manual disconnect system with the disconnect part detached from the battery part while fuse assembly remains connected to the battery part.
Figure 7C:
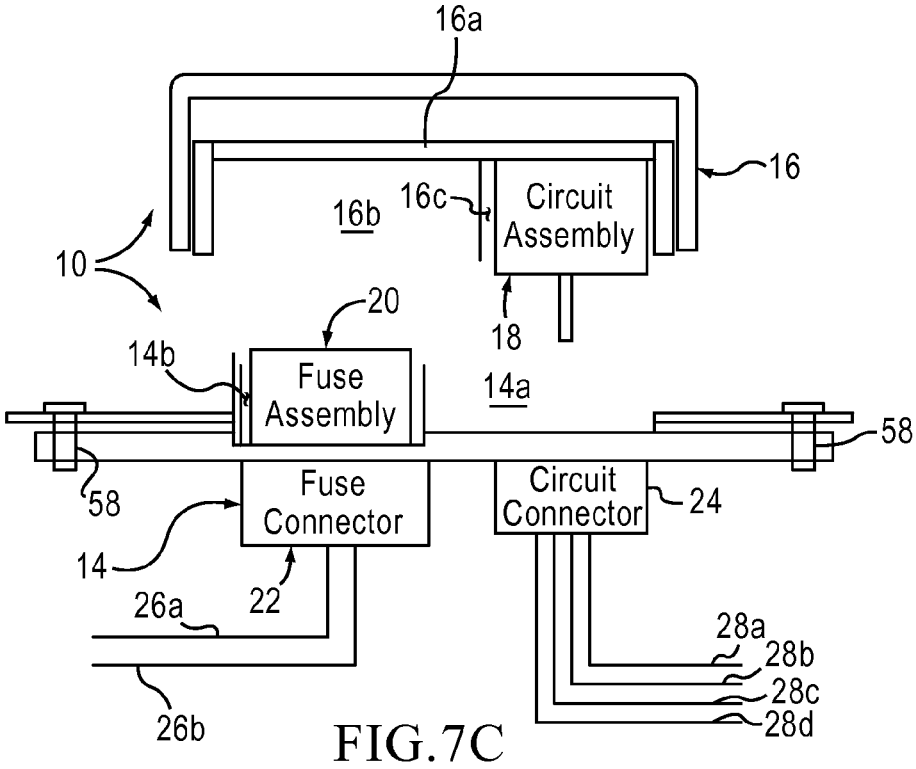
FIG. 7C is a diagrammatical view of the manual disconnect system with the disconnect part detached from the battery part thereby disconnecting a circuit assembly from a circuit connector while the fuse assembly remaining in the battery part remains connected to a fuse connector.

In FIGS. 3-7C, the battery part 14 has a main compartment 14*a* and a fuse assembly subcompartment 14*b*. The fuse assembly subcompartment 14*b* is disposed in the main compartment 14*a*. The disconnect part 16 has a shielding cover 16*a* that defines a disconnect part cavity 16*b*. As best illustrated in FIGS. 4A-6A, the disconnect part 16 is connected to the battery part 14 and is detachable therefrom as shown in FIGS. 7A-7C. One of ordinary skill in the art would appreciate that the disconnect part 16 is releasably connected to the battery part 14.

As best shown in FIGS. 4C, 5C and 6C, the circuit assembly 18 is disposed in the disconnect part cavity 16*b* and is also connected to the shielding cover 16*a*. The fuse assembly 20 is sized and adapted to be releasably received by the fuse assembly subcompartment 14*b*. The fuse connector 22 and the circuit connector 24 are connected to the battery part 14.

Figure 8A:
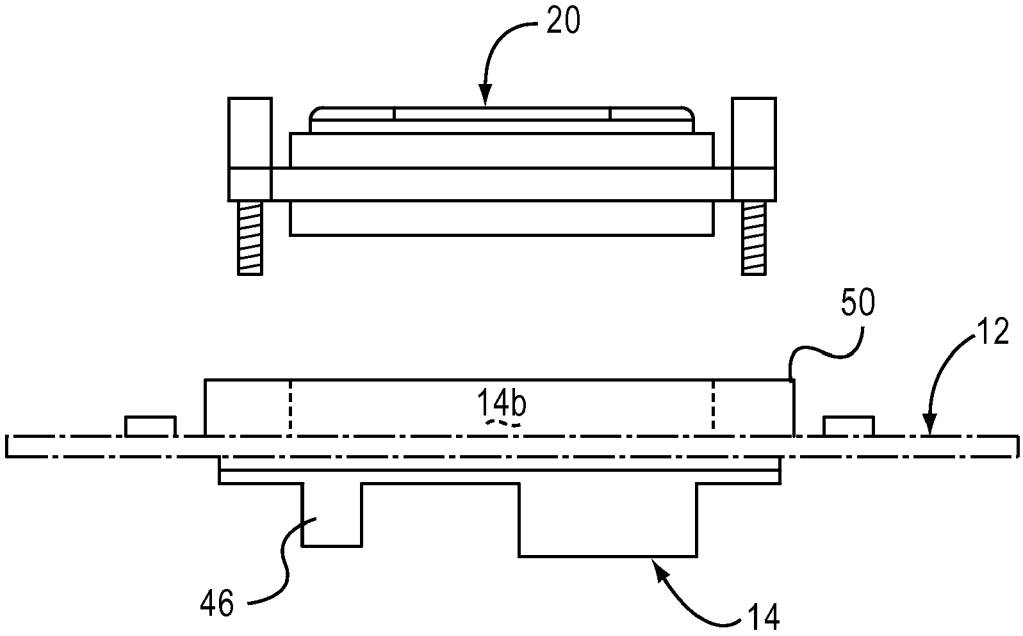
FIG. 8A is a side elevation view of the manual disconnect system with the fuse assembly detached from the battery part.
Figure 8B:
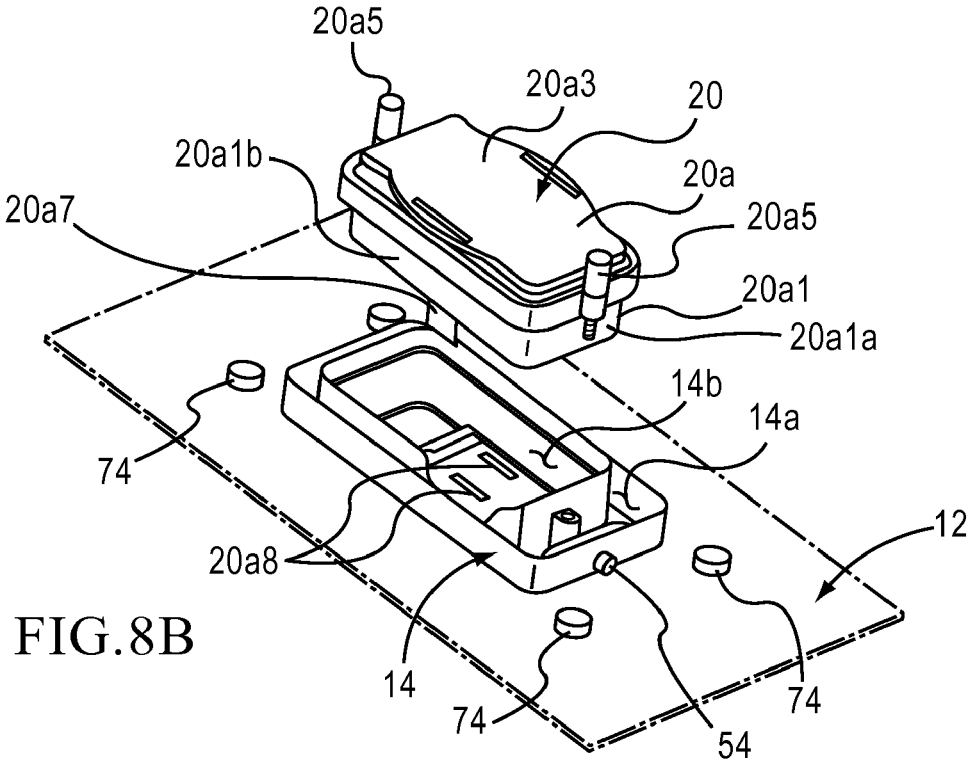
FIG. 8B is a perspective view of the manual disconnect system with the fuse assembly detached from the battery part.
Figure 8C:
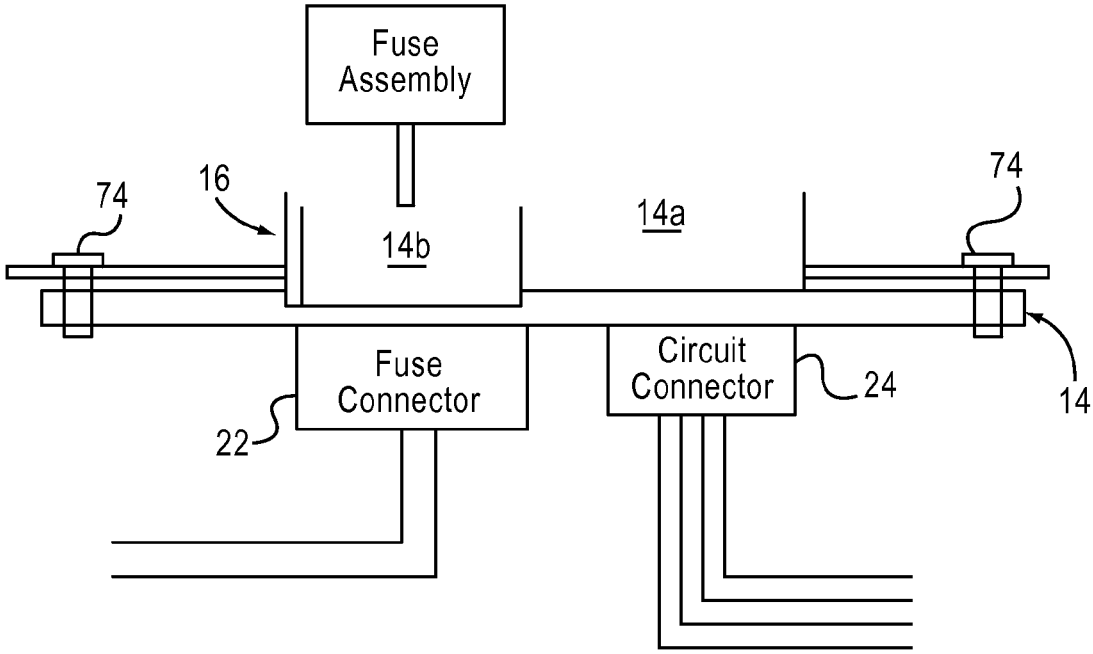
FIG. 8C is a diagrammatical view of the manual disconnect system with the fuse assembly detached from the battery part and disconnected from the fuse connector.

In FIGS. 4A, 4C, 5A, 5C, 6A and 6C, when the disconnect part 16 is releasably connected to the battery part 14, the fuse assembly 20 and the fuse connector 22 are electrically connected together and the circuit assembly 18 and the circuit connector 24 are electrically connected together. In FIGS. 7A-7C, upon detaching the disconnect part 16 and the battery part 14 from each other, the circuit assembly 18 and the circuit connector 24 are electrically disconnected from one another while the fuse assembly 20 remains releasably connected to the battery part 14 in the fuse assembly subcompartment 14*b* and electrically connected to the fuse connector 22. After the disconnect part 16 and the battery part 14 are detached from each other and the circuit assembly 18 and the circuit connector 24 are disconnected from one another, the fuse assembly 20 is exposed as shown in FIGS. 7A-7C so that the fuse assembly 20 is accessible for disconnection from the fuse connector 22 and removal from the fuse assembly subcompartment 14*b*. Thereafter, the fuse assembly 20 can be detached from the fuse connector 22 and removed from the fuse assembly subcompartment 14*b* as shown in FIGS. 8A-8C As shown in FIGS. 1, 3 and 4A-7C the disconnect part 16 includes a lever member 30 that is operably connected to the disconnect part 16. The lever member 30 pivots to and between a lock position (best illustrated in FIGS. 4A-4C) and a release position (illustrated in FIGS. 6A-6C). As discussed in more detail below, in the lock position, the lever member 30 engages the battery part 14 to prevent detachment of the disconnect part 16 and the battery 14 part from each other. In the release position, the disconnect part 16 and the battery part 14 are detachable from one another.

The following specifically describes the disconnect part 16 for the manual disconnect system 10.

In FIGS. 1, 3, 4A, 5A, 6A, 7A, 7B and 8B, the disconnect part 16 includes the shielding cover 16*a* that has a generally box-shaped configuration. The shielding cover 16*a* has a base wall 16*a*1, a front wall 16*a*2, a rear wall 16*a*3 and a pair of opposing side walls 16*a*4 that are connected to each other to define the disconnect part cavity 16*b* (FIGS. 3A and 3B) which, in turn, also has a generally box-shaped configuration. The disconnect part cavity 16*b* has a circuit assembly compartment 16*c* enclosed in the disconnect part cavity 16*b* as that shown in FIGS. 3A, 3B, 4C, 5C, 6C and 7C. The disconnect part 16 also includes the lever member 30 that has a generally U-shaped configuration as that shown in FIGS. 3A and 3B. The lever member 30 is pivotally connected to the shielding cover 16*a* as shown in FIGS. 1 and 4A-7C. The U-shaped lever member 30 has a pair of arm members 30*a* and a cross-member 30*b* interconnecting the pair of arm members 30*a*. Respective ones of the pair of arm members 30*a* are pivotally connected to respective ones of the pair of opposing side walls 16*a*4. As discussed above, the lever member 30 is operative to move to and between lock position (as best illustrated in FIGS. 4A-C) and the release position (as illustrated in FIGS. 6A-C).

As shown in FIGS. 3A and 3B, the disconnect part 16 also includes a pair of pivot pins 32 that are disposed apart from one another and aligned coextensively along a common pivot axis PA. Respective ones the pivot pins 32 interconnect respective ones of the pair of side walls 16*a*4 and arm members 30*a* as best shown in FIG. 1. In FIGS. 3A and 3B, each one of the pair of arm members 30*a* includes a free end arm portion 30*a*1 and each free end arm portion 30*a*1 having a pair of tabs 30*a*1*a* and 30*a*1*b* that are disposed apart from one another to define a recess 34 therebetween.

Figure 9:
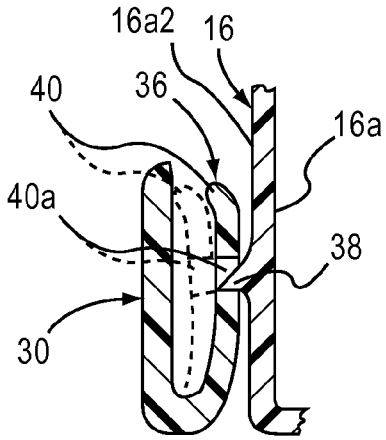
FIG. 9 is a partial side elevation view in cross-section taken along line 9-9-9 in FIG. 1.

Also, as shown in FIGS. 1 and 9, the disconnect part 16 includes a latch mechanism 36. The latch mechanism 36 is operative to retain the cross-member 30*b* forwardly of front wall 16*a*2 when the lever member 30 is in the lock position (FIGS. 4A-4C).

As best shown in FIG. 9, the front wall 16*a*2 includes a latch projection 38. The latch projection 38 extends from the front wall 16*a*2. Note that the cross-member 30*b* includes a living hinge piece 40 that has a latch hole 40*a* that is sized to receive the latch projection 38. As shown in FIG. 9, the living hinge piece 40 is moveable to and between a latched state (drawn in solid lines) and an unlatched state (drawn in phantom). In the latched state, the latch projection 38 is received by the latch hole 40*a*. In the unlatched state, the living hinge piece 40 moves away from the front wall (drawn in phantom) so that the latch projection 38 is disposed apart from the latch hole 40*a*. As understood by one of ordinary skill in the art, the living hinge piece 40 has a normally relaxed condition (drawn in solid lines) and a flexed condition (drawn in phantom). As would be understood by one of ordinary skill in the art in view of FIG. 9, the living hinge piece 40 is resiliently biased to the normally relaxed condition, is in the normally relaxed condition when in the latched state and is in the flexed condition when in the unlatched state.

By way of example only and not by way of limitation, when the cross-member 30*b* is in the lock position, the cross-member 30*b* is positioned forwardly of the front wall 16*a*2 as shown in FIGS. 1, 4A and 4C. In the release position, the cross member 30*b* is positioned above the base wall 16*a*1 as shown in FIGS. 6A, 6B, 7A and 7B.

The following specifically describes the battery part 14 for the manual disconnect system 10. With reference to FIGS. 2 and 3, the battery part 14 includes a battery part body member 42, a fuse connector housing unit 44 and a circuit connector housing unit 46. The battery part body member 42 has a mounting plate 48. The mounting plate 48 has a top mounting plate surface 48*a* and a bottom mounting plate surface 48*b* that is disposed apart from the top mounting plate surface 48*a*. The top mounting plate surface 48*a* and the bottom mounting plate surface 48*b* define a mounting plate thickness 48*c* therebetween. The battery part body member 42 also includes an outer circumferential wall 50 that projects from the top mounting plate surface 48*a* to define the main compartment 14*a* and an inner circumferential wall 52 that is disposed apart from the outer circumferential wall 50 and inside the main compartment 14*a* to define the fuse assembly subcompartment 14*b* that is disposed in the main compartment 14*a*.

In FIG. 2, the fuse connector housing unit 44 is connected to the bottom mounting plate surface 48*b* of the mounting plate 48 and is in communication with the fuse assembly subcompartment 14*b*. The circuit connector housing unit 46 projects from the bottom mounting plate surface 48*b* of the mounting plate 48 and extends into and is in communication with the main compartment 14*a*.

With reference to FIGS. 3A and 3B, the outer circumferential wall 50 is generally rectangularly shaped as viewed in plan view and has a pair of opposing short side walls 50*a* and a pair of opposing long side walls 50*b* that interconnect the respective ones of the pair of opposing short side walls 50*a*. Each one of the pair of opposing long side walls 50*b* is longer than respective ones of the pair of opposing short side walls 50*a*.

Again with reference to FIGS. 3A and 3B, the battery part 14 includes a pair of latch pins 54 that are disposed apart from one another. Respective ones of the pair of latch pins 54 are connected to and extend outwardly from respective ones of the pair of short side walls 50*a*. Further, the pair of latch pins 54 extend coexistently along a common latch pin axis LPA as best shown in FIGS. 3A and 3B.

As illustrated in FIGS. 3A and 3B, the mounting plate 48 has an endless groove 56 formed into the top mounting plate surface 48*a* that encircles the outer circumferential wall 50. The mounting plate 48 includes a plurality of mounting plate holes 58 that are formed therethrough. The plurality of mounting plate holes 58 are disposed between the endless groove 56 and the outer circumferential wall 50. The battery part 14 also has a plurality of caps 60. As best shown in FIGS. 2, 3, 4A, 5A, 6A and 10, each one of the plurality of caps 60 is integrally connected to the bottom mounting plate surface 48*b*. Also, in FIG. 10, each cap 60 has a cap hole 60*a* that extends partially into the cap 60. Again, with reference to FIG. 10, the cap hole 60*a* is in registration with a respective one of the plurality of the mounting plate holes 58.

As that shown in FIGS. 3A and 3B, the battery part 14 further includes a pair of internally-threaded tubes 62 that are disposed apart from one another in the main compartment 14*a*. The pair of internally-threaded tubes 62 are integrally connected to and exteriorly of the inner circumferential wall 52 on opposing sides thereof. Also, the battery part 14 has a circuit connector conduit 64. The circuit connector conduit 64 is connected to the mounting plate 48 and is disposed in the main compartment 14*a*. The circuit connector conduit 64 defines a circuit connector passageway 64*a* that extends to and between the main compartment 14*a* and exteriorly of the bottom mounting plate surface 48*b*. The circuit connector housing unit 46 is in communication with the circuit connector passageway 64*a*. The circuit connector housing unit 46 includes a circuit connector housing 46*a*, a circuit connector terminal position assurance device 46*b* and a circuit connector O-ring seal 46*c*. The circuit connector housing 46*a* first receives the circuit connector ring seal 46*c* and then the circuit connector housing 46*a* receives the circuit connector terminal position assurance device 46*b*. The circuit connector terminal position assurance device 46*b* retains the circuit connector ring seal 46*c* in the circuit connector housing 46*a*.

In FIGS. 3, 4A, 5A, 6A and 7A, the circuit connector housing 46*a* includes a circuit connector terminal arrangement 46*a*1, a pair of circuit connector internally-threaded tubes 46*a*2 connected to the circuit connector terminal arrangement 46*a*1 and a pair of circuit connector thumb screws 46*a*3. Respective ones of the circuit connector threaded tubes 46*a*2 rotatably receive respective ones of the pair of circuit connector thumb screws 46*a*3 for releasably connecting the circuit connector housing unit 46 to the bottom mounting plate surface 48*b* by threadably engaging mounting plate thumb screw holes 48*d* shown in FIG. 2.

As best shown in FIGS. 3, 7B and 8B, the following specifically describes the fuse assembly 20 of the manual disconnect system 10. By way of example only and not by way of limitation, the fuse assembly 20 includes a generally box-shaped fuse assembly housing 20*a* that has a base section 20*a*1 forming a fuse-receiving compartment 20*a*2, a cover section 20*a*3, a pair of tube elements 20*a*4, a pair of thumb screws 20*a*5, a fuse 20*a*6 (FIGS. 3A and 3B) and a pair of busbars 20*a*7 electrically connected to the fuse 20*a*6. The cover section 20*a*3 is sized for removably covering the base section 20*a*1 in order to enclose the fuse-receiving compartment 20*a*2. The base section 20*a*1 has a first pair of opposing base section side walls 20*a*1*a*, a second pair of opposing base section side walls 20*a*1*b* that are connected to the first pair of opposing base section side walls 20*a*1*a* and a base section bottom wall 20*a*1*c* (FIGS. 3A and 3B) connected thereto. Respective ones of the tube elements 20*a*4 are integrally connected exteriorly to respective ones of the first pair of opposing base section side walls 20*a*1*a*. Respective ones of the pair of thumb screws 20*a*5 are rotatably disposed in respective ones of the tube elements 20*a*4. The fuse 20*a*6 is disposed in the fuse-receiving compartment 20*a*2 such that the busbars 20*a*7 extend from the fuse-receiving compartment 20*a*2, through busbar-receiving holes 20*a*8. The busbar-receiving holes 20*a*8 are formed through the bottom wall

20*a*1*c* to communicate exteriorly of the base section bottom wall 20*a*1*c* of the base section 20*a*1.

Figure 10:
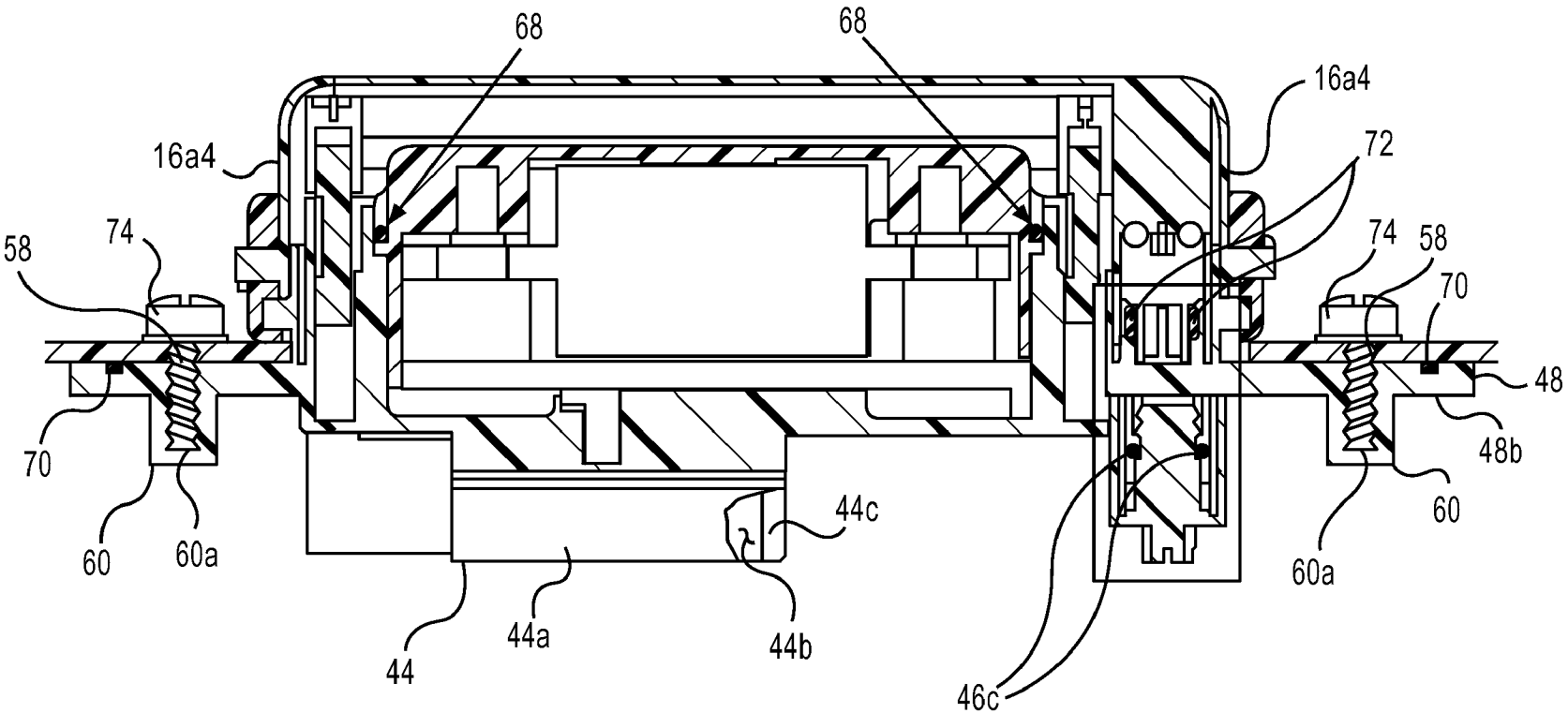
FIG. 10 is a front elevation view of the manual disconnect system in cross-section emphasizing the seals thereof.

The manual disconnect system 10 of the present invention as particularly illustrated in FIGS. 3 and 10 is a sealed manual disconnect system 10 that includes the components described hereinabove. A detailed discussion of the components already described above is not deemed necessary for the understanding of the sealed manual disconnect system 10 and those additional components necessary for understanding the sealed manual disconnect system 10 are hereinafter described. The sealed manual disconnect system 10 includes the battery part 14, the circuit connector housing unit 46, the fuse connector housing unit 44, the fuse assembly 20, the disconnect part 16 and the circuit assembly 18 described above. Additionally, the sealed manual disconnect system 10 also includes the circuit connector O-ring seal 46*c*, a fuse assembly O-ring seal 68, a mounting plate O-ring seal 70, a circuit assembly O-ring seal 72 and a plurality of fasteners 74.

Again, with reference to FIGS. 4A, 5A, 6A and 7A, the fuse connector housing unit 44 is connected to the bottom mounting plate surface 48*b* of the mounting plate 48 and is in communication with the fuse assembly subcompartment 14*b*. Again, with reference to FIGS. 3 and 10, the fuse assembly O-ring seal 68 sized to surround and contact the base section 20*a*1 of the fuse assembly 20 and the mounting plate O-ring seal 70 is sized to be received in part by the endless grove 56. The support member opening 12*c* receives the outer circumferential wall 50 in a manner that the top mounting plate surface 48*a* and the bottom support surface 12*b* are facially opposed to one another with the mounting plate O-ring 70 disposed therebetween. With the plurality of mounting plate holes 58 in registration with respective ones of the plurality of support member attachment holes 12*d*, respective ones of the plurality of fasteners 74 extend through support member attachment holes 12*d* and into respective ones of the plurality of mounting plate holes 58 to secure the battery part 14 to the support member 12. Additionally, the fuse assembly 20 is disposed in the fuse assembly subcompartment 14*b* and is releasably connected to the battery part 14 with the fuse assembly O-ring seal 68 being in simultaneous contact with the first pair of base section side walls 20*a*1*a* and the second pair of base section side walls 20*a*1*b* of the fuse assembly 20 and an inner circumferential surface 52*a* of the inner circumferential wall 52. And, when the disconnect part 16 is releasably connected to the battery part 14, the circuit assembly O-ring seal 66 is disposed between and in contact with the circuit assembly 18 and the circuit connector conduit 64.

Furthermore, the fuse connector housing unit 44 includes a pair of hollow terminal-receiving tube sections 44*a*. Each hollow terminal-receiving tube section 44*a* defines a terminal-receiving tube section opening 44*b* thereinto. Further, respective ones of the pair of hollow terminal-receiving tube sections 44*a* house respective ones of a pair of terminal-receiving tube section O-ring seals 44*c*. Respective ones of the pair of terminal-receiving tube sections on O-ring seals are disposed adjacent to respective ones of the terminal-receiving tube section openings 44*b*.

One of ordinary skill in the art would appreciate that the manual disconnect system 10 of the present invention can be employed with vehicles such as automobiles, trucks, boats and the like. Further, a skilled artisan would appreciate that the disconnect part 16 can be disposed in the passenger compartment of the vehicle while the battery part 14 is disposed exteriorly of the passenger compartment of the vehicle. Because of the construction of the manual disconnect system 10 as described by way of example above, undesirable fluids, fumes or other possible dangerous byproducts that might be generated exteriorly of the passenger compartment are prevented from entering into the passenger compartment through the manual disconnect system 10 based, at least in part, on the seals as described above. Furthermore, the present invention is particularly useful in high-current applications because the disengagement of the shielding cover 16*a* is capable of disabling a high-current connection. Also, no tools are required to remove the disconnect part 16 from the battery part 14 nor are any small parts such as nuts, bolts and screws needed to removably retain the battery part 14 and the disconnect part 16 together.

The present invention, may, however, be embodied in various different forms and should not be construed as limited to the exemplary embodiments set forth herein; rather, these exemplary embodiments are provided so that this disclosure will be thorough and complete and will fully convey the scope of the present invention to those skilled in the art.

What is claimed is:

1. A manual disconnect system, comprising:

a battery part having a main compartment with fuse assembly subcompartment disposed in the main compartment;

a disconnect part having a shielding cover defining a disconnect part cavity, the disconnect part being releasably connected to the battery part;

a circuit assembly disposed in the disconnect part cavity and connected to the shielding cover;

a fuse assembly sized and adapted to be releasably received by the fuse assembly subcompartment; and a fuse connector and a circuit connector connected to the battery part, wherein, when the disconnect part is releasably connected to the battery part, the fuse assembly and the fuse connector are electrically connected together and the circuit assembly and the circuit connector are electrically connected together, and, upon detaching the disconnect part and the battery part from each other, the circuit assembly and the circuit connector are electrically disconnected from one another while the fuse assembly remains releasably connected to the battery part in the fuse assembly subcompartment and electrically connected to the fuse connector.

2. A manual disconnect system according to claim 1, wherein, after the disconnect part and the battery part are detached from each other and the circuit assembly and the circuit connector are disconnected from one another, the fuse assembly is exposed so that the fuse assembly is accessible for disconnection from the fuse connector and removal from the fuse assembly subcompartment.

3. A manual disconnect system according to claim 1, wherein, the disconnect part includes a lever member operably connected thereto, the lever member pivots to and between a lock position and a release position such that, in the lock position, the lever member engages the battery part to prevent detachment of the disconnect part and the battery part from each other and, in the release position, the disconnect part and the battery part are detachable from one another.

4. A disconnect part for a manual disconnect system, comprising:

a generally box-shaped shielding cover having a base wall, a front wall, a rear wall and a pair of opposing side walls connected to each other to define a generally-boxed shaped disconnect part cavity;

a circuit assembly compartment disposed in the disconnect part cavity;

a U-shaped lever member pivotally connected to the shielding cover, the U-shaped lever member having a pair of arm members and a cross-member interconnecting the pair of arm members with respective ones of the pair of arm members pivotally connected to respective ones of the pair of opposing side walls, the lever member operative to move to and between a lock position and a release position; and a latch mechanism operative to retain the cross-member forwardly of front wall when the lever member is in the lock position, wherein the front wall includes a latch projection extending therefrom and the cross-member includes a living hinge piece having a latch hole sized to receive the latch projection, the living hinge piece moveable to and between a latched state in which the latch projection is received by the latch hole and an unlatched state in which the living hinge piece moves away from the front wall so that the latch projection is disposed apart from the latch hole, the living hinge piece having a normally relaxed condition and a flexed condition, the living hinge piece being resiliently biased to the normally relaxed condition, being in the normally relaxed condition when in the latched state and being in the flexed condition when in the unlatched state.

5. A disconnect part for a manual disconnect system according to claim 4, further comprising a pair of pivot pins disposed apart from one another and aligned coextensively along a common pivot axis, respective ones the pivot pins interconnecting respective ones of the pair of side walls and the pair of arm members.

6. A disconnect part for a manual disconnect system according to claim 4, wherein each one of the pair of arm members includes a free end arm portion having a pair of tabs disposed apart from one another to define a recess therebetween.

7. A disconnect part for a manual disconnect system according to claim 4, wherein, in the lock position, the cross-member is positioned forwardly of the front wall and, in the release position, the cross member is positioned above the base wall.

8. A battery part for a manual disconnect system, comprising:

a battery part body member including a mounting plate having a top mounting plate surface and a bottom mounting plate surface disposed apart from the top mounting plate surface to define a mounting plate thickness therebetween, an outer circumferential wall projecting from the top mounting plate surface to define a main compartment and an inner circumferential wall disposed apart from the outer circumferential wall and inside the main compartment to define a fuse assembly subcompartment disposed in the main compartment;

a fuse connector housing unit connected to the bottom mounting plate surface of the mounting plate and being in communication with the fuse assembly subcompartment; and a circuit connector housing unit projecting from the bottom mounting plate surface of the mounting plate and extending into and being in communication with the main compartment.

9. A battery part for a manual disconnect system according to claim 8, wherein the outer circumferential wall is generally rectangularly shaped and has a pair of opposing short side walls and a pair of opposing long side walls interconnecting the respective ones of the pair of opposing short side walls, each one of the pair of opposing long side walls being longer than respective ones of the pair of opposing short side walls.

10. A battery part for a manual disconnect system according to claim 8, further comprising a pair of latch pins disposed apart from one another, respective ones of the pair of latch pins being connected to and extending outwardly from respective ones of the pair of short side walls, the pair of latch pins extending coexistently along a common latch pin axis.

11. A battery part for a manual disconnect system according to claim 8, wherein the mounting plate includes an endless groove formed into the top mounting plate surface encircling the outer circumferential wall.

12. A battery part for a manual disconnect system according to claim 11, wherein the mounting plate includes a plurality of mounting plate holes formed therethrough, the plurality of mounting plate holes being disposed between the endless groove and the outer circumferential wall.

13. A battery part for a manual disconnect system according to claim 12, further comprising a plurality of caps integrally connected to the bottom mounting plate surface, each cap having a cap hole extending partially thereinto and being in registration with a respective one of the plurality of the mounting plate holes.

14. A battery part for a manual disconnect system according to claim 8, further comprising a pair of internally-threaded tubes disposed apart from one another in the main compartment.

15. A battery part for a manual disconnect system according to claim 14, wherein the pair of internally-threaded tubes being integrally connected to and exteriorly of the inner circumferential wall on opposing sides thereof.

16. A battery part for, a manual disconnect system according to claim 8, further comprising a circuit connector conduit connected to the mounting plate and disposed in the main compartment, the circuit connector conduit defining a circuit connector passageway extending to and between the main compartment and exteriorly of the bottom mounting plate surface.

17. A battery part for a manual disconnect system according to claim 16, wherein the circuit connector housing unit is in communication with the circuit connector passageway and includes a circuit connector housing, a circuit connector terminal position assurance device and a circuit connector O-ring seal, the circuit connector housing first receives the circuit connector O-ring seal and then receives the circuit connector terminal position assurance device to retain the circuit connector O-ring seal in the circuit connector housing.

18. A battery part for a manual disconnect system according to claim 17, wherein the circuit connector housing includes a pair of circuit connector threaded tubes, a circuit connector terminal arrangement, a pair of circuit connector internally-threaded tubes connected to the circuit connector terminal arrangement and a pair of circuit connector thumb screws, respective ones of the circuit connector threaded tubes rotatably receive respective ones of the pair of circuit connector thumb screws for releasably connecting the circuit connector housing unit to the bottom mounting plate surface.

19. A fuse assembly for a manual disconnect system, comprising:

a generally box-shaped fuse assembly housing having a base section forming a fuse-receiving compartment, a cover section, a pair of tube elements, a pair of thumb screws, a fuse and a pair of busbars electrically connected to the fuse, the cover section sized to removably cover the base section to enclose the fuse-receiving compartment, the base section having a first pair of opposing base section side walls, a second pair of opposing base section side walls connected to the first pair of opposing base section side walls and a base section bottom wall connected thereto, respective ones of the tube elements integrally connected exteriorly to respective ones of the first pair of opposing base section side walls, respective ones of the pair of thumb screws rotatably disposed in respective ones of the tube elements, the fuse disposed in the fuse-receiving compartment such that the busbars extend from the fuse-receiving compartment, through fuse-receiving holes formed through the bottom wall to communicate exteriorly of the base section bottom wall.

20. A sealed manual disconnect system adapted for mounting to a support member having a top support surface, an opposite bottom support surface, a support member opening formed through and between the top support surface and the bottom support surface and a plurality of support member attachment holes disposed outwardly relative to the support member opening, the manual disconnect system, comprising:

a battery part having a battery part body member including a mounting plate and a circuit connector conduit connected to the mounting plate, the mounting plate having a top mounting plate surface and a bottom mounting plate surface disposed apart from the top mounting plate surface to define a mounting plate thickness therebetween, an outer circumferential wall projecting from the top mounting plate surface to define a main compartment and an inner circumferential wall disposed apart from the outer circumferential wall and inside the main compartment to define a fuse assembly subcompartment disposed in the main compartment, the outer circumferential wall being generally rectangularly shaped and has a pair of opposing short side walls and a pair of opposing long side walls interconnecting the respective ones of the pair of opposing short side walls, each one of the pair of opposing long side walls being longer than respective ones of the pair of opposing short side walls, the mounting plate including an endless groove formed into the top mounting plate surface encircling the outer circumferential wall and a plurality of mounting plate holes formed therethrough, the plurality of mounting plate holes being disposed between the endless groove and the outer circumferential wall and in registration with respective ones of the plurality of support member attachment holes, the circuit connector conduit and disposed in the main compartment, the circuit connector conduit defining a circuit connector passageway extending to and between the main compartment and exteriorly of the bottom mounting plate surface;

a circuit connector housing unit projecting from the bottom mounting plate surface of the mounting plate and extending into and being in communication with the main compartment, the circuit connector housing unit being in communication with the circuit connector passageway and includes a circuit connector housing, a circuit connector terminal position assurance device and a circuit connector O-ring ring seal, the circuit connector housing first receives the circuit connector O-ring seal and then receives the circuit connector terminal position assurance device to retain the circuit connector O-ring seal in the circuit connector housing;

a fuse connector housing unit connected to the bottom mounting plate surface of the mounting plate and being in communication with the fuse assembly subcompartment;

a fuse assembly having a generally box-shaped fuse assembly housing with a circumferentially-extending base section forming a fuse-receiving compartment, a cover section, a pair of tube elements, a pair of thumb screws, a fuse and a pair of busbars electrically connected to the fuse, the cover section sized to removably covering the base section to enclose the fuse-receiving compartment, the base section having a first pair of opposing base section side walls, a second pair of opposing base section side walls and a bottom wall connected thereto, respective ones of the tube elements integrally connected exteriorly to respective ones of the first pair of opposing base section side walls, respective ones of the pair of thumb screws rotatably disposed in respective ones of the tube elements, the fuse disposed in the fuse-receiving compartment such that the busbars extend from the fuse-receiving compartment, through fuse-receiving holes formed through the bottom wall to project exteriorly of the bottom wall of the base section;

a fuse assembly O-ring seal sized to surround and contact the base section of the fuse assembly;

a mounting plate O-ring seal sized to be received in part by the endless groove;

a disconnect part having a shielding cover defining a disconnect part cavity, the disconnect part being releasably connected to the battery part;

a circuit assembly disposed in the disconnect part cavity and connected to the shielding cover;

a circuit assembly O-ring seal; and a plurality of fasteners, wherein the support member opening receives the outer circumferential wall in a manner that the top mounting plate surface and the bottom support surface are facially opposed to one another with the mounting plate O-ring disposed therebetween, respective ones of the plurality of fasteners extend through support member attachment holes and into respective ones of the plurality of mounting plate holes to secure the battery part to the support member, the fuse assembly is disposed in the fuse assembly subcompartment and releasably connected to the battery part with the fuse assembly O-ring seal being in simultaneous contact with the first and second pairs of base section side walls of the fuse assembly and an inner circumferential surface of the inner circumferential wall, and, when the disconnect part is releasably connected to the battery part, the circuit assembly O-ring seal is disposed between and in contact with the circuit assembly and the circuit connector conduit.

21. A sealed manual disconnect system according to claim 20, wherein the fuse connector housing unit includes a pair of hollow terminal-receiving tube sections, each hollow terminal-receiving tube section defining a terminal-receiving tube section opening thereinto.

22. A sealed manual disconnect system according to claim 21, further comprising a pair of terminal-receiving tube section O-ring seals, respective ones of the pair of hollow terminal-receiving tube sections housing a respective one of the pair of terminal-receiving tube section O-ring seals adjacent respective ones of the terminal-receiving tube section openings.

* * * * *